US010647545B2

(12) United States Patent
Scoville et al.

(10) Patent No.: US 10,647,545 B2
(45) Date of Patent: May 12, 2020

(54) DISPATCHING OPTIMIZATION BASED ON PRESENCE

(71) Applicant: Otis Elevator Company, Farmington, CT (US)

(72) Inventors: Bradley Armand Scoville, Farmington, CT (US); Adam Kuenzi, Silverton, OR (US)

(73) Assignee: OTIS ELEVATOR COMPANY, Farmington, CT (US)

( * ) Notice: Subject to any disclaimer, the term of this patent is extended or adjusted under 35 U.S.C. 154(b) by 400 days.

(21) Appl. No.: 15/638,744

(22) Filed: Jun. 30, 2017

(65) Prior Publication Data

US 2019/0002237 A1 Jan. 3, 2019

(51) Int. Cl.
*B66B 1/46* (2006.01)

(52) U.S. Cl.
CPC ..... *B66B 1/468* (2013.01); *B66B 2201/103* (2013.01); *B66B 2201/4615* (2013.01); *B66B 2201/4638* (2013.01); *B66B 2201/4653* (2013.01); *B66B 2201/4684* (2013.01)

(58) Field of Classification Search
CPC ..... B66B 1/468
USPC ..... 187/382
See application file for complete search history.

(56) References Cited

U.S. PATENT DOCUMENTS 5,984,051 A 11/1999 Morgan et al.
7,426,981 B2 9/2008 Bacellar et al.
9,079,751 B2 7/2015 Sundholm et al.
9,087,246 B1 7/2015 Chin et al.
9,483,887 B1 11/2016 Soleimani
9,538,332 B1 1/2017 Mendelson
10,118,797 B2 * 11/2018 Keser ..... B66B 1/468
10,273,117 B2 * 4/2019 Buckman ..... H04W 4/80
2009/0006846 A1 1/2009 Rosenblatt
2013/0133986 A1 5/2013 De Vincentis
2015/0156567 A1 6/2015 Oliver et al.
2015/0339871 A1 11/2015 Wagner et al.
2016/0012486 A1 1/2016 Vartanian et al.
(Continued)

FOREIGN PATENT DOCUMENTS

CN 205590105 U 9/2016
WO 2008116963 A1 10/2008
(Continued)

OTHER PUBLICATIONS

Dunn, Zach, "Using iBeacons to sense presence", Robin Powered, 2017, available https://robinpowered.com/blog/using-ibeacons-to-detect-presence-in-a-room/, 6 pgs.
(Continued)

*Primary Examiner* — David S Warren
(74) *Attorney, Agent, or Firm* — Cantor Colburn LLP

(57) ABSTRACT

A method of calling an elevator car from a mobile device is provided. The method comprising: receiving a first elevator call from a first mobile device on a first floor, the first elevator call including a destination request to travel to a second floor; moving an elevator car to the first floor in response to the first elevator call; detecting whether the first mobile device is within the elevator car at the first floor; and adjusting operation of the elevator car in response to each mobile device detected within the elevator car.

17 Claims, 2 Drawing Sheets

(56) References Cited

U.S. PATENT DOCUMENTS

Figure 1:
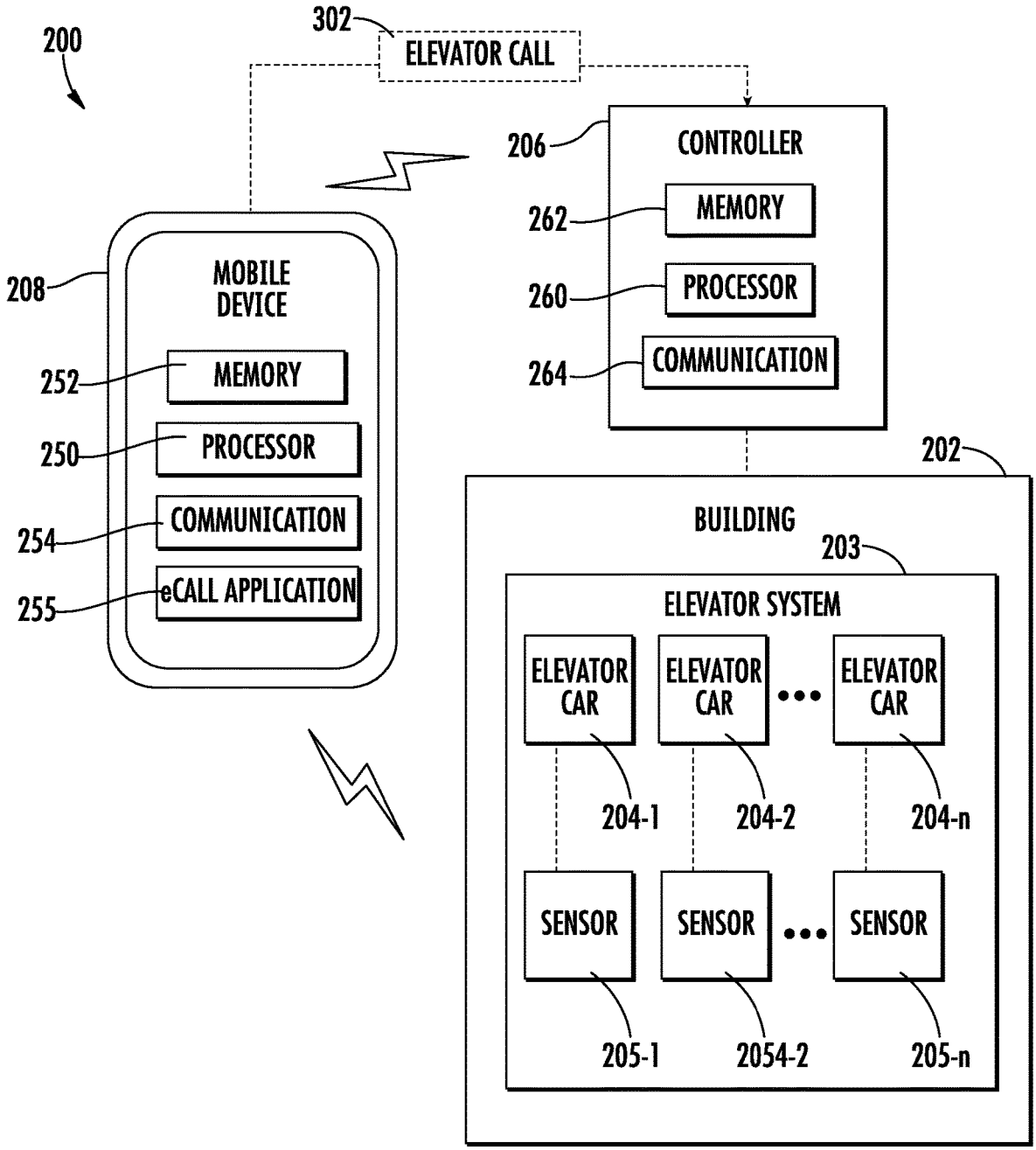

| | | | | |
|---|---|---|---|---|
| 2016/0122157 | A1* | 5/2016 | Keser | B66B 1/468 187/388 |
| 2016/0248782 | A1 | 8/2016 | Troesch | |
| 2016/0277560 | A1 | 9/2016 | Gruberman et al. | |
| 2016/0284147 | A1 | 9/2016 | Trani | |
| 2016/0356605 | A1 | 12/2016 | Zur et al. | |
| 2017/0088397 | A1* | 3/2017 | Buckman | H04W 4/80 |
| 2018/0044134 | A1* | 2/2018 | Copeland | B66B 1/3492 |
| 2019/0002237 | A1* | 1/2019 | Scoville | B66B 1/468 |
| 2019/0161316 | A1* | 5/2019 | Nichols | B66B 1/2408 |
| 2019/0161317 | A1* | 5/2019 | Nichols | B66B 1/2408 |
| 2019/0168993 | A1* | 6/2019 | Kuenzi | B66B 1/3461 |
| 2019/0263626 | A1* | 8/2019 | Daniels | B66B 1/3461 |

FOREIGN PATENT DOCUMENTS

| | | | |
|---|---|---|---|
| WO | 2014178790 | A1 | 11/2014 |
| WO | 2015197178 | A1 | 12/2015 |
| WO | 2016089837 | A1 | 6/2016 |
| WO | 2016100293 | A1 | 6/2016 |

OTHER PUBLICATIONS

Machado, Carlos, "Bluetooth Beacons for Tracking?", Accuware Blog available at: https://www.accuware.com/blog/bluetooth-beacons-tracking/, 2017, 3 pages.

Extended European Search Report for Application No. 18180963.3-1017; Report dated Nov. 30, 2018; Report Received Date: Dec. 5, 2018; 8 pages.

* cited by examiner

DISPATCHING OPTIMIZATION BASED ON PRESENCE

BACKGROUND

The subject matter disclosed herein generally relates to the field of elevator systems, and more particularly to an apparatus and method for calling elevator cars within the elevator system.

Existing elevator systems allow a user to submit an elevator call (e.g., a hall call or a destination call) using their own mobile device (e.g., a smartphone). Current system cannot determine whether the specific user who made the elevator call actually ends up boarding the elevator car.

BRIEF SUMMARY

According to one embodiment, a method of calling an elevator car from a mobile device is provided. The method comprising: receiving a first elevator call from a first mobile device on a first floor, the first elevator call including a destination request to travel to a second floor; moving an elevator car to the first floor in response to the first elevator call; detecting whether the first mobile device is within the elevator car at the first floor; and adjusting operation of the elevator car in response to each mobile device detected within the elevator car.

In addition to one or more of the features described above, or as an alternative, further embodiments may include where the detecting further comprises: connecting to the first mobile device using at least one of Wi-Fi and Bluetooth; and determining a distance between the elevator car and the first mobile device.

In addition to one or more of the features described above, or as an alternative, further embodiments may include where the detecting further comprises: detecting a wireless signal of the first mobile device, wherein the sensor does not connect to the wireless signal; and determining a distance between the elevator car and the first mobile device.

In addition to one or more of the features described above, or as an alternative, further embodiments may include where the detecting further comprises: detecting a beacon transmitted by a sensor proximate the elevator car using the first mobile device; and determining a distance between the elevator car and the first mobile device in response to a strength of the beacon.

In addition to one or more of the features described above, or as an alternative, further embodiments may include where the detecting further comprises: emitting an audio transmission from the first mobile device; detecting the audio transmission using a sensor proximate the elevator car; and determining a distance between the elevator car and the first mobile device in response to a gain of the audio transmission.

In addition to one or more of the features described above, or as an alternative, further embodiments may include where the detecting further comprises: emitting an audio transmission from a sensor proximate the elevator car; detecting the audio transmission using the first mobile device; and determining a distance between the elevator car and the first mobile device in response to a gain of the audio transmission.

In addition to one or more of the features described above, or as an alternative, further embodiments may include moving the elevator car to the second floor when the first mobile device is detected within the elevator car.

In addition to one or more of the features described above, or as an alternative, further embodiments may include cancelling the first elevator call when the first mobile device is not detected within the elevator car after a selected period of time.

In addition to one or more of the features described above, or as an alternative, further embodiments may include calling a second elevator car when the first mobile device is not detected within the elevator car after a selected period of time.

In addition to one or more of the features described above, or as an alternative, further embodiments may include receiving a second elevator call from a second mobile device on a third floor, the second elevator call including a destination request to travel to a fourth floor; and moving the elevator car to the third floor in response to the second elevator call.

In addition to one or more of the features described above, or as an alternative, further embodiments may include receiving a second elevator call from a second mobile device on the first floor, the second elevator call including a destination request to travel to a third floor; and detecting whether the second mobile device is within the elevator car at the first floor.

In addition to one or more of the features described above, or as an alternative, further embodiments may include moving the elevator car to the second floor and the third floor when the first mobile device and the second mobile device are detected within the elevator car.

In addition to one or more of the features described above, or as an alternative, further embodiments may include cancelling the first elevator call when the first mobile device is not detected within the elevator car after a selected period of time; and moving the elevator car to the third floor when the second mobile device is detected within the elevator car.

In addition to one or more of the features described above, or as an alternative, further embodiments may include cancelling the second elevator call when the second mobile device is not detected within the elevator car after a selected period of time; and moving the elevator car to the second floor when the first mobile device is detected within the elevator car.

According to another embodiment, an elevator system is provided. The elevator system comprising: an elevator car; a controller in electronic communication with the elevator car, the controller configured to receive a first elevator call from a first mobile device on a first floor, wherein the first elevator call includes a destination request to travel to a second floor, wherein the controller is configured to move the elevator car to the first floor in response to the first elevator call; and a sensor in electronic communication with the controller, the sensor is configured to detect whether the first mobile device is within the elevator car at the first floor; wherein the controller is configured to adjust operation of the elevator car in response to each mobile device detected within the elevator car.

In addition to one or more of the features described above, or as an alternative, further embodiments may include where the sensor uses at least one of Wi-Fi and Bluetooth to detect the first mobile device and determine a distance between the first mobile device and the elevator car to detect when the first mobile device is located within the elevator car.

In addition to one or more of the features described above, or as an alternative, further embodiments may include where the sensor uses a wireless signal of the first mobile device to detect the first mobile device and determine a distance between the first mobile device and the elevator car to detect when the first mobile device is located within the elevator car, wherein the sensor does not connect to the wireless signal.

In addition to one or more of the features described above, or as an alternative, further embodiments may include where the sensor transmits a beacon; and the first mobile device is configured to detect the beacon and determine a distance between the elevator car and the first mobile device in response to a strength of the beacon.

In addition to one or more of the features described above, or as an alternative, further embodiments may include where the first mobile device is configured to emit an audio transmission; and the sensor is configured to detect the audio transmission and determine a distance between the elevator car and the first mobile device in response to a gain of the audio transmission.

According to another embodiment, a computer program product tangibly embodied on a computer readable medium is provided. The computer program product including instructions that, when executed by a processor, cause the processor to perform operations comprising: receiving a first elevator call from a first mobile device on a first floor, the first elevator call including a destination request to travel to a second floor; moving an elevator car to the first floor in response to the first elevator call; detecting whether the first mobile device is within the elevator car at the first floor; and adjusting operation of the elevator car in response to each mobile device detected within the elevator car.

Technical effects of embodiments of the present disclosure include the ability for an elevator control system to receive elevator destination calls from a mobile device and then detect whether the mobile device boards the elevator.

The foregoing features and elements may be combined in various combinations without exclusivity, unless expressly indicated otherwise. These features and elements as well as the operation thereof will become more apparent in light of the following description and the accompanying drawings. It should be understood, however, that the following description and drawings are intended to be illustrative and explanatory in nature and non-limiting.

BRIEF DESCRIPTION

Figure 2:
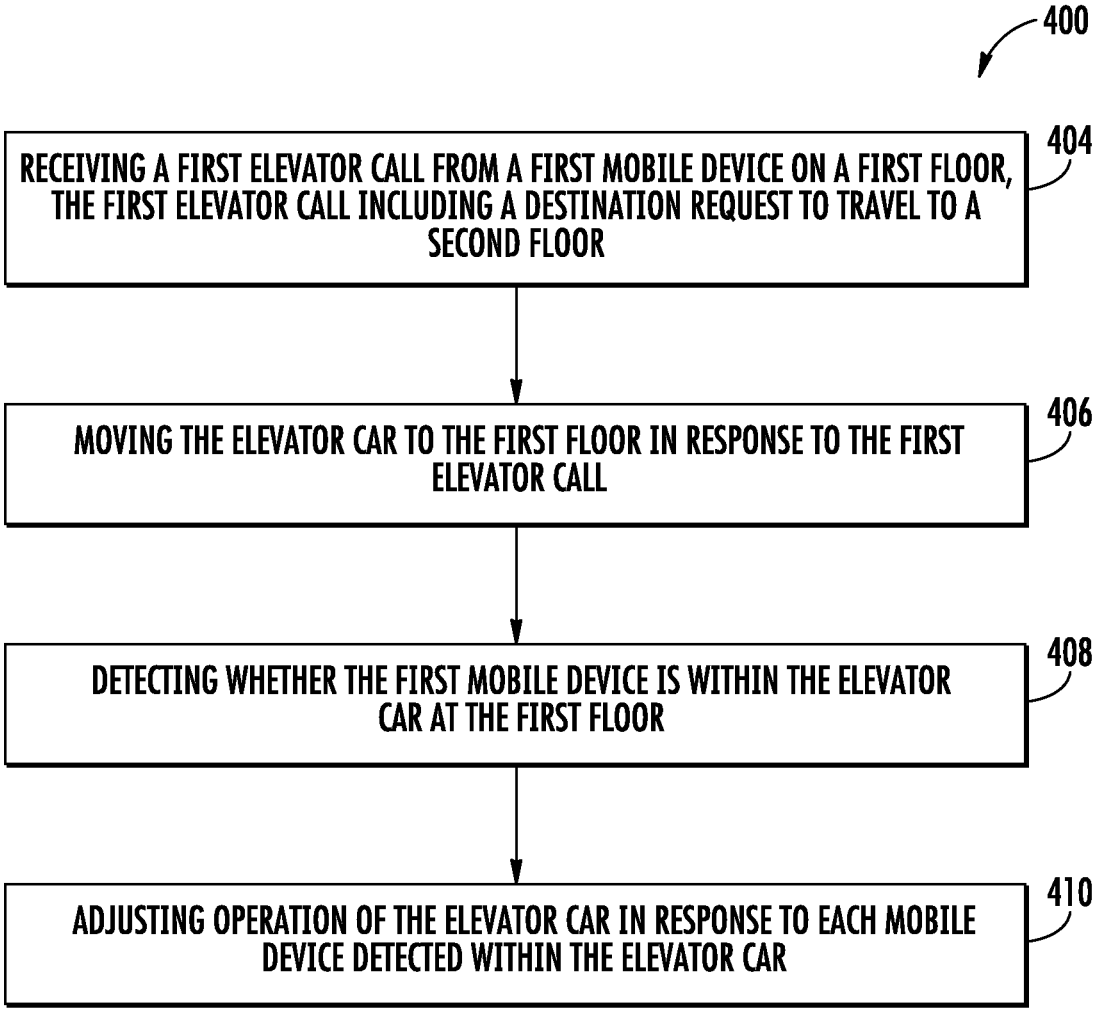

The following descriptions should not be considered limiting in any way. With reference to the accompanying drawings, like elements are numbered alike:

FIG. 1 illustrates a schematic view of an elevator call control system, in accordance with an embodiment of the disclosure; and FIG. 2 is a flow diagram illustrating a method of calling an elevator car from a mobile device, according to an embodiment of the present disclosure.

DETAILED DESCRIPTION

A detailed description of one or more embodiments of the disclosed apparatus and method are presented herein by way of exemplification and not limitation with reference to the Figures.

FIG. 1 depicts an elevator call control system 200 in an example embodiment. The elevator call control system 200 includes an elevator system 203 installed at a building 202. In some embodiments, the building 202 may be a building or a collection of buildings that may or may not be physically located near each other. The building 202 may include any number of floors. Persons entering the building 202 may enter at a lobby floor, or any other floor, and may go to a destination floor via one or more conveyance devices, such as the elevator system 203.

The elevator system 203 may be operably connected to one or more computing devices, such as a controller 206. The controller 206 may be configured to control dispatching operations for one or more elevator cars (e.g., elevator cars 204-1, 204-2, . . . **204-*n*) associated with the elevator system 203. It is understood that the elevator system 203 may utilize more than one controller 206, and that each controller may control a group of elevators cars 204-1 and 204-2. Although two elevator cars 204-1 and 204-2 are shown in FIG. 1, it is understood that any number of elevators cars 204-*n* may be used in the elevator system 203. The elevator cars 204-1 and 204-2 may be located in the same hoistway or in different hoistways so as to allow coordination amongst elevator cars 204-1 and 204-2 in different elevator banks serving different floors. It is understood that other components of the elevator system 203** (e.g., drive, counterweight, safeties, etc.) are not depicted for ease of illustration.

The controller 206 may include a processor 260, memory 262 and communication module 264 as shown in FIG. 1. The processor 260 can be any type or combination of computer processors, such as a microprocessor, microcontroller, digital signal processor, application specific integrated circuit, programmable logic device, and/or field programmable gate array. The memory 262 is an example of a non-transitory computer readable storage medium tangibly embodied in the controller 206 including executable instructions stored therein, for instance, as firmware. The communication module 264 may implement one or more communication protocols as described in further detail herein.

Also shown in FIG. 1 is a mobile device 208. The mobile device 208 may be a mobile computing device that is typically carried by a person, such as, for example a smart phone, PDA, smart watch, tablet, laptop, etc. The mobile device 208 may include a touch screen (not shown). The mobile device 208 may include a processor 250, memory 252 and communication module 254 as shown in FIG. 1. The processor 250 can be any type or combination of computer processors, such as a microprocessor, microcontroller, digital signal processor, application specific integrated circuit, programmable logic device, and/or field programmable gate array. The memory 252 is an example of a non-transitory computer readable storage medium tangibly embodied in the mobile device 208 including executable instructions stored therein, for instance, as firmware. The communication module 254 may implement one or more communication protocols as described in further detail herein. The mobile device 208 belongs to a resident or employee of the building 202 who currently has access to the elevator system 203. Each mobile device 208 may transmit an elevator call 302 to the controller 206 and the controller 206 will move an elevator car 204 in response to the elevator call 302. The elevator call 302 may include a "boarding floor" and a "destination floor." The "boarding floor" is where the person with the mobile device 208 desires to board the elevator car 204 and the "destination floor" is where the person with the mobile device 208 intends to travel too. In one embodiment, the elevator call 302 may only include the "destination floor" and the "boarding floor" may be automatically determined by the elevator system 203. Embodiments herein generate a graphical user interface on the mobile device 208 through an eCall application 255. The mobile device 208 may transmit an elevator call 302 through an eCall application 255.

The mobile device 208 and the controller 206 communicate with one another. For example, the mobile device 208 and the controller 206 may communicate with one another when proximate to one another (e.g., within a threshold distance). The mobile device 208 and the controller 206 may communicate over a wireless network, such as 802.11x (WiFi), short-range radio (Bluetooth), cellular, satellite, etc. In some embodiments, the controller 206 may include, or be associated with (e.g., communicatively coupled to) a networked element, such as kiosk, beacon, hall call fixture, lantern, bridge, router, network node, door lock, elevator control panel, building intercom system, etc. The networked element may communicate with the mobile device 208 using one or more communication protocols or standards. For example, the networked element may communicate with the mobile device 208 using near field communications (NFC). A connection between the mobile device 208 and the controller 206 may be direct between mobile device 208 and controller 206 or it may be through a web service. The connection also may include security elements such as VPN or authentication or encryption. In other embodiments, the controller 206 may establish connection with a mobile device 208 that is inside and/or outside of the building 202 in order to detect a location of the mobile device 208. A location of the mobile device may be determined using various technologies including GPS, triangulation, trilateration, signal strength detection, accelerometer detection, gyroscopic detection, or barometric pressure sensing by way of non-limiting example. The triangulation and trilateration may use various wireless technologies including but not limited to Wi-Fi and Bluetooth. In example embodiments, the mobile device 208 communicates with the controller 206 over multiple independent wired and/or wireless networks. Embodiments are intended to cover a wide variety of types of communication between the mobile device 208 and controller 206, and embodiments are not limited to the examples provided in this disclosure. Communication between the mobile device 208 and the controller 206 will allow the controller 206 to determine the location of the mobile device 208 in relation to the elevator system 203. The location of the mobile device 208 may be communicated to the controller 206 through a plurality of sensors 205, discussed further below.

The elevator system 203 also includes one or more sensors 205 (e.g., 205-1, 205-2, . . . **205-*n*). The controller 206 is in electronic communication with each sensor 205 through a wired connection and/or wireless connection. In an alternative embodiment, each sensor may be in indirect communication with the controller 206 through the mobile device 208. In a non-limiting example, if the sensors 205 are a Bluetooth beacon, then the mobile device 208 can detect when it is in proximity of the sensor 205, then the mobile device 208 can communicate with the controller 206 that it is in the elevator car 204. Although two sensors 205-1 and 205-2 are shown in FIG. 1, it is understood that any number of sensors 205-*n* may be used in the elevator system 203. Further, although only one sensor 205 is shown per elevator car 204 for ease of illustration it is understood that each elevator car 204 may contain one or more sensors 205. Each sensor 205 is configured to detect operational data of the elevator car 204, such as for example, elevator door position (e.g. open/closed), elevator car location, speed, voltage, vibration, acceleration, noise, deceleration, jerk, and any other performance parameter of any component of the elevator system 204** known to one of skill in the art.

The sensors 205 detect the presence of an individual in a car and identify the individual using various sensing technology, such as, for example Wi-Fi transceivers, Bluetooth transceivers, radio transceivers, visual recognition cameras, people counters, microphones, etc. to detect persons and/or mobile devices entering and leaving the elevator car. The type and nature of sensors 205 within the sensor system 203 is not limited to the embodiments disclosed herein. The mobile device 208 and the sensors 205 communicate with one another. For example, the mobile device 208 and the sensors 205 may communicate with one another when proximate to one another (e.g., within a threshold distance). The mobile device 208 and the sensors 205 may communicate over a wireless network, such as 802.11x (Wi-Fi), ZigBee, Z-Wave and short-range radio (Bluetooth).

In an embodiment, the sensors 205 may include a Wi-Fi transceiver to connect to a mobile device 208 when the mobile device 208 enters the elevator car 204 in order to identify the mobile device 208. In another embodiment, the sensors 205 may include a Bluetooth transceiver to connect to a mobile device 208 when the mobile devices 208 enters the elevator in order to identify the mobile device 208. The sensors 205 are configured to detect a distance between the elevator car 204 and the mobile device 208 to determine whether the mobile device 208 is entering and/or leaving the elevator car 204.

Communication between the mobile device 208 and the sensors 205 can be one-way or two-way communication. In one example, if Bluetooth is utilized then the mobile device 208 may advertise a Bluetooth signal and the sensors 205 may receive it. In another example, the sensors 205 may advertise a Bluetooth signal and the mobile device 208 may receive it. In another example, there may be two-way Bluetooth communication between the sensors 205 and the mobile device 208. In another example, a Wi-Fi transceiver (i.e. sensor 205) may be placed in an elevator car and the mobile device may detect the Wi-Fi beacon frame as part of the 802.11x protocol as well as the received signal strength of that beacon frame to approximate the distance between the Wi-Fi transceiver and the mobile device 208 but not connect to the Wi-Fi signal. In another example, the mobile device 208 may actively send a probe request looking for Wi-Fi transceivers, then a Wi-Fi transceiver (i.e. sensor 205) located in an elevator car may extract the MAC address of the mobile device 208 from the probe request and approximate distance between the Wi-Fi transceiver and the mobile device 208 from received signal strength.

In another embodiment, the sensors 205 may include a visual recognition camera to detect each person entering and leaving an elevator car and map connect the person with their mobile device 208. Advantageously, knowing the identity of the mobile device 208 helps determine if the mobile device 208 has placed an elevator call 302 and the destination floor of the mobile device 208.

In another embodiment, the mobile device 208 and the sensors 205 may communicate over a non-radio frequency network. In an example the mobile device 208 and the sensors 205 may communicate through audio transmission, such as, for example a high frequency audio transmission. The mobile device 208 may emit a chirp signature between 15 kHz-20 kHz that one or more microphones (i.e. sensor 205) can detect and extract a signature to determine which mobile device 208 is present. In this example, Audio gain at speaker may be measured to a distance between the microphone and the mobile device 208 may be determined in response to the audio gain. Advantageously, more microphones may help better determine distance. Alternatively, the speakers (i.e. sensors 205) may be located in the elevators car and may emit the high frequency audit for the mobile device 208 to detect. Advantageously, one or more speakers may be help better determine distance.

Referring now to FIG. 2 with continued reference to FIG. 1. FIG. 2 shows a flow chart of method 400 calling an elevator car 204 from a mobile device 208, in accordance with an embodiment of the disclosure. At block 404, a first elevator call 302 is received from a first mobile device on the first floor. The first elevator call 302 includes a destination request to travel to a second floor. The elevator call 302 may also include the first floor as the boarding floor or the controller 206 may determine that the first floor is the boarding floor. Multiple elevator calls 302 may be received from multiple mobile devices. The controller 206 will organize the incoming elevator calls 302 and allocate elevator cars 204 accordingly to service each elevator call 302. For example, a single elevator car 204 may be assigned to pick up multiple mobile devices 208 on a single floor and then transport each mobile device 208 to the same destination floor or different destination floors. At block 406, an elevator car 204 is moved to the first floor in response to the first elevator call 302. As the elevator car 204 is moving towards the first floor, the controller 206 may transmit elevator information to mobile devices 208 waiting for the elevator car 204 including but not limited to the estimate time of arrival (ETA) at the first floor, the speed of the elevator car 204, and the elevation of the elevator car 204.

At block 408, it is detected whether the first mobile device is within the elevator car at the first floor. As mentioned above, the elevator car 204 may be assigned to multiple mobile devices 208 and it will be detected whether each mobile device has entered the elevator car 204. The controller 206 may hold the elevator car 204 at the first floor for a selected period of time waiting for mobile devices 208 that transmitted elevator calls 302 to board the elevator car 204. Once the selected period of time has ended, the controller 206 may determine that any mobile devices 208 not currently in the elevator car 204 are no longer coming and the controller 206 may cancel the elevator calls 302 for the mobile devices 208 not in the elevator car 204. Instead of canceling the elevator call 302 outright when the mobile device 208 is not in the elevator car 204, the controller 206 may call another elevator car 204 to pick up the mobile device 208 at a later time. An alarm may be activated on the mobile device 208 when an elevator call 302 is canceled and/or transferred to another elevator car 204. The alarm may be audible, visual, and/or vibratory. The controller 206 may then adjust the run schedule for the elevator car 204 by cancelling the destinations that are no longer needed due to mobile devices 208 failing to board the elevator car 204. For example, if no mobile device 208 boards the elevator car 204 then the entire elevator car 204 may be reassigned to handle other elevator calls 302. The controller 206 will then move the elevator car 204 to destination floors of the mobile devices that did board the elevator car 204. As the elevator car 204 is moving towards the destination floor, the controller 206 may transmit elevator information to mobile devices 208 within the elevator car 204 including but not limited to the estimate time of arrival (ETA) at the destination floor, the speed of the elevator car 204, and the elevation of the elevator car 204. The elevator information may be displayed on the mobile device 208 through the eCall application 255.

As mentioned above, a sensor 205 may detect that a mobile device 208 is in an elevator car 204 by connecting to the mobile device 208 through at least one of Wi-Fi and Bluetooth and determining a distance between the elevator car 204 and the mobile device 208. The sensor 205 may detect that a mobile device 208 is in an elevator car 204 by detecting a wireless signal of the mobile device 208 and determining a distance between the elevator car 204 and the mobile device 208. The sensor 205 does not connect to the wireless signal. The wireless signal may be Bluetooth. The location of each sensor 205 relative to the elevator car 204 is known, thus by detecting the signal (ex: WiFi and Bluetooth) strength between the sensor 205 and the mobile device 208, the controller 206 may then determine the distance between the elevator car 204 and the mobile device 208.

As also mentioned above, a sensor 205 may detect that a mobile device 208 is in an elevator car 204 by detecting an audio transmission emitted by the mobile device 208 and determining a distance between the elevator car 204 and the mobile device 208 in response to a gain of the audio transmission. Alternatively, the sensor 205 may emit the audio transmission and the mobile device 208 may detect the audio transmission and determine a distance between the elevator car 204 and the mobile device 208 in response to a gain of the audio transmission. The location of each sensor 205 relative to the elevator car 204 is known, thus by detecting the gain of the audio transmission between the sensor 205 and the mobile device 208, the controller 206 may then determine the distance between the elevator car 204 and the mobile device 208. As mentioned above, the audio transmission may be a high frequency audio transmission.

At block 410, operation of the elevator car 204 may be adjusted in response to each mobile device 208 detected within the elevator car 204. Once the mobile device 208 is determined to be inside the elevator car 204, then the controller 206 will confirm the destination floor associated with each mobile device 208 inside the elevator car 204 and move the elevator car 204 to each destination floor. For example, the elevator car 204 will move to destination floors of mobile devices 208 detected within the elevator car 204 and not to the destination floors of mobile devices 208 not detected in the elevator car 204.

While the above description has described the flow process of FIG. 2 in a particular order, it should be appreciated that unless otherwise specifically required in the attached claims that the ordering of the steps may be varied.

As described above, embodiments can be in the form of processor-implemented processes and devices for practicing those processes, such as a processor. Embodiments can also be in the form of computer program code containing instructions embodied in tangible media, such as network cloud storage, SD cards, flash drives, floppy diskettes, CD ROMs, hard drives, or any other computer-readable storage medium, wherein, when the computer program code is loaded into and executed by a computer, the computer becomes a device for practicing the embodiments. Embodiments can also be in the form of computer program code, for example, whether stored in a storage medium, loaded into and/or executed by a computer, or transmitted over some transmission medium, loaded into and/or executed by a computer, or transmitted over some transmission medium, such as over electrical wiring or cabling, through fiber optics, or via electromagnetic radiation, wherein, when the computer program code is loaded into an executed by a computer, the computer becomes an device for practicing the embodiments. When implemented on a general-purpose microprocessor, the computer program code segments configure the microprocessor to create specific logic circuits.

The term "about" is intended to include the degree of error associated with measurement of the particular quantity based upon the equipment available at the time of filing the application. For example, "about" can include a range of ±8% or 5%, or 2% of a given value.

The terminology used herein is for the purpose of describing particular embodiments only and is not intended to be limiting of the present disclosure. As used herein, the singular forms "a", "an" and "the" are intended to include the plural forms as well, unless the context clearly indicates otherwise. It will be further understood that the terms "comprises" and/or "comprising," when used in this specification, specify the presence of stated features, integers, steps, operations, elements, and/or components, but do not preclude the presence or addition of one or more other features, integers, steps, operations, element components, and/or groups thereof.

While the present disclosure has been described with reference to an exemplary embodiment or embodiments, it will be understood by those skilled in the art that various changes may be made and equivalents may be substituted for elements thereof without departing from the scope of the present disclosure. In addition, many modifications may be made to adapt a particular situation or material to the teachings of the present disclosure without departing from the essential scope thereof. Therefore, it is intended that the present disclosure not be limited to the particular embodiment disclosed as the best mode contemplated for carrying out this present disclosure, but that the present disclosure will include all embodiments falling within the scope of the claims.

What is claimed is:

1. A method of calling an elevator car from a mobile device, the method comprising:

receiving a first elevator call from a first mobile device on a first floor, the first elevator call including a destination request to travel to a second floor;

moving an elevator car to the first floor in response to the first elevator call;

detecting whether the first mobile device is within the elevator car at the first floor;

adjusting operation of the elevator car in response to each mobile device detected within the elevator car; and detecting that the first mobile device is not within the elevator car after a selected period of time, wherein when the first mobile device is not detected within the elevator car after a selected period of time the method further comprises at least one of:

cancelling the first elevator call; and calling a second elevator car.

2. The method of claim 1, wherein the detecting further comprises:

connecting to the first mobile device using at least one of Wi-Fi and Bluetooth; and determining a distance between the elevator car and the first mobile device.

3. The method of claim 1, wherein the detecting further comprises:

detecting a wireless signal of the first mobile device, wherein the sensor does not connect to the wireless signal; and determining a distance between the elevator car and the first mobile device.

4. The method of claim 1, wherein the detecting further comprises:

detecting a beacon transmitted by a sensor proximate the elevator car using the first mobile device; and determining a distance between the elevator car and the first mobile device in response to a strength of the beacon.

5. The method of claim 1, wherein the detecting further comprises:

emitting an audio transmission from the first mobile device;

detecting the audio transmission using a sensor proximate the elevator car; and determining a distance between the elevator car and the first mobile device in response to a gain of the audio transmission.

6. The method of claim 1, wherein the detecting further comprises:

emitting an audio transmission from a sensor proximate the elevator car;

detecting the audio transmission using the first mobile device; and determining a distance between the elevator car and the first mobile device in response to a gain of the audio transmission.

7. The method of claim 1, further comprising:

receiving a second elevator call from a second mobile device on a third floor, the second elevator call including a destination request to travel to a fourth floor; and moving the elevator car to the third floor in response to the second elevator call.

8. The method of claim 1, further comprising:

receiving a second elevator call from a second mobile device on the first floor, the second elevator call including a destination request to travel to a third floor; and detecting whether the second mobile device is within the elevator car at the first floor.

9. The method of claim 8, further comprising:

moving the elevator car to the second floor and the third floor when the first mobile device and the second mobile device are detected within the elevator car.

10. The method of claim 8, further comprising:

cancelling the first elevator call when the first mobile device is not detected within the elevator car after a selected period of time; and moving the elevator car to the third floor when the second mobile device is detected within the elevator car.

11. The method of claim 8, further comprising:

cancelling the second elevator call when the second mobile device is not detected within the elevator car after a selected period of time; and moving the elevator car to the second floor when the first mobile device is detected within the elevator car.

12. An elevator system comprising:

an elevator car;

a controller in electronic communication with the elevator car, the controller configured to receive a first elevator call from a first mobile device on a first floor, wherein the first elevator call includes a destination request to travel to a second floor, wherein the controller is configured to move the elevator car to the first floor in response to the first elevator call; and a sensor in electronic communication with the controller, the sensor is configured to detect whether the first mobile device is within the elevator car at the first floor;

wherein the controller is configured to adjust operation of the elevator car in response to each mobile device detected within the elevator car, and wherein when the first mobile device is not detected within the elevator car after a selected period of time the controller is configured to adjust operation of the elevator car by at least one of:

cancelling the first elevator call; and calling a second elevator car.

13. The elevator system of claim 12, wherein:

the sensor uses at least one of Wi-Fi and Bluetooth to detect the first mobile device and determine a distance between the first mobile device and the elevator car to detect when the first mobile device is located within the elevator car.

14. The elevator system of claim 12, wherein:

the sensor uses a wireless signal of the first mobile device to detect the first mobile device and determine a distance between the first mobile device and the elevator car to detect when the first mobile device is located within the elevator car, wherein the sensor does not connect to the wireless signal.

15. The elevator system of claim 12, wherein:

the sensor transmits a beacon; and the first mobile device is configured to detect the beacon and determine a distance between the elevator car and the first mobile device in response to a strength of the beacon.

16. The elevator system of claim 12, wherein:

the first mobile device is configured to emit an audio transmission; and the sensor is configured to detect the audio transmission and determine a distance between the elevator car and the first mobile device in response to a gain of the audio transmission.

17. A computer program product tangibly embodied on a computer readable medium, the computer program product including instructions that, when executed by a processor, cause the processor to perform operations comprising:

receiving a first elevator call from a first mobile device on a first floor, the first elevator call including a destination request to travel to a second floor;

moving an elevator car to the first floor in response to the first elevator call;

detecting whether the first mobile device is within the elevator car at the first floor; and adjusting operation of the elevator car in response to each mobile device detected within the elevator car; and detecting that the first mobile device is not within the elevator car after a selected period of time, wherein when the first mobile device is not detected within the elevator car after a selected period of time the method further comprises at least one of:

cancelling the first elevator call; and calling a second elevator car.

* * * * *